US007998041B1

(12) United States Patent
Johnson

(10) Patent No.: US 7,998,041 B1
(45) Date of Patent: Aug. 16, 2011

(54) RUBBER BAND MUSCULOSKELETAL EXERCISE DEVICE

(76) Inventor: Rob Lee Johnson, Akron, OH (US)

( * ) Notice: Subject to any disclaimer, the term of this patent is extended or adjusted under 35 U.S.C. 154(b) by 0 days.

(21) Appl. No.: 11/454,495

(22) Filed: Jun. 16, 2006

Related U.S. Application Data

(60) Provisional application No. 60/691,985, filed on Jun. 17, 2005.

(51) Int. Cl.
*A63B 21/02* (2006.01)

(52) U.S. Cl. ..... 482/124

(58) Field of Classification Search ..... 482/121–130, 482/139, 148, 907–908
See application file for complete search history.

(56) References Cited

U.S. PATENT DOCUMENTS 5,993,362 A * 11/1999 Ghobadi ..... 482/124
6,287,242 B1 * 9/2001 Fray ..... 482/121
6,659,921 B2 * 12/2003 Vernon ..... 482/124

* cited by examiner

*Primary Examiner* — Lori Baker
(74) *Attorney, Agent, or Firm* — Michael D. Eisenberg

(57) ABSTRACT

A shell harness comprises particular harness slots for an attachment and a detachment of rubber bands. The rubber bands are covered with a protection sleeve that traps the band and slows it down in an event of a break. The rubber bands are connected to foot straps with stirrups that also comprise a vinyl hose. A hollow, cylindrical hand grip is comprised at an end of the rubber bands too after they are interlaced through the harness.

15 Claims, 8 Drawing Sheets

RUBBER BAND MUSCULOSKELETAL EXERCISE DEVICE

RELATED APPLICATIONS

The present application claims benefit of U.S. Provisional Application 60/691,985 filed on Jun. 17, 2005. The entire disclosure and contents of the above applications are hereby incorporated by reference.

BACKGROUND OF THE INVENTION

1. Field of the Invention

The present invention relates to a simulated human musculoskeletal comprising an improved harness having a water resistant shell exterior comprising rubber bands, connected to handles and foot straps in particularly to a human musculoskeletal exercising apparatus of the type worn on the body, whereby the user can get a feel for constant dynamic motion while ballistic ally stimulating and strengthening the muscles of the upper and lower body simultaneously. The apparatus is a group of rubber bands laced through a harness in order to correspond with the user's extremities as to collectively function together with the human musculoskeletal jointed parts. The rubber bands offer resistance to a series of multidirectional movements of force such as jogging around a gym on a wooden floor while shadow boxing or while being in a static position doing straight leg pull downs, leg press, and sit ups or rowing. The exercise apparatus is light weight portable in a personalized hand carrying bag.

2. Description of the Related Art

The surgeon general has determined that the lack of exercise is detrimental to your health. For example lack of exercise is the leading cause of obesity especially among youths in the United States. American College of Sports Medicine suggests all adults should engage in 30 minutes or more of moderately intense physical activity daily. A variety of exercises may be recommended along with changing the order of the exercise routine once every four weeks to minimize repetitive orthopedic stresses of exercising daily. In an effort to increase the effectiveness of exercise activities most people have used hand held weights only to experience shoulder injuries in an attempt to enhance weight loss which requires ballistic stimulus of the large muscle groups and increased heart rate to burn more calories. Ballistic stimulus is rapid accelerated repetitive movement to failure against rubber band resistance; use of rubber bands can cause the physiological effects essential for weight loss. The use of rubber bands offers increased resistance against multidirectional motions. There have also been many devices which include belts, harnesses, vest and elastic tubes or bungee cords, these arrangements limit the range of motion and or resistance required for simulating the cling and jerk, wrestling shadow boxing, core abdominal resistance and do not provide for upper body eccentric movement such as torquing at the waist, oblique maneuvers resistance, shoulder rotation, triceps push downs or any compounding exercises such as squat and press, triceps push down or standing press simultaneously while performing squats and other compound exercise capabilities. Jogging, stair stepping, and cycling are beneficial aerobic exercise but do very little toward building muscle. Elastic tubes and cords are extensively used for stretching by force; the present invention is most effective for muscle stimulation building strength and stamina when user movement of limbs is at maximum velocities for single repetitions. Conventionally clips and hooks are used to fasten the ends of these elastic cords shown in the prior art. The present invention provides a closed loop rubber band member and connector arrangement to be a Tie wrap around a cylindrical light weight hose preferably made of plastic vinyl. The present invention may also provide for the use of elastic tubes and cords. There remains a need for an exercise device that uses rubber bands built in layers on mandrels with no seams for potential breakage, but must have a long life cycle of use. There remains a need for a exercise device that can be used out in the field for conditioning and strengthening military personnel and used for training in any given sport such as football, basket ball, weight lifting, tennis swimming, soccer, running, boxing, etc. that is simple to manufacture and readily available at an affordable cost and provide various resistance rubber bands of different lengths which can be changed in order to accommodate the physical size, fitness level of the user with out incurring the expensive cost of changing the size of the mandrel used to produce the rubber bands. In addition there is a further need for an exercise device that will fit properly on all users by tying the rubber bands together in a knot in order to length adjust the resistance. It would be desirable if an exercise device would be provided a water repellent shell harness that is not costly or complicated in nature, but dynamic, absorbs impact shock made with high tensile strength withstanding distortion and will lend itself to wide spread appeal for wide spread of potential users which range from novice exercisers to elite athletes. It is a further object of the present invention to provide a method for easily attaching the rubber bands to a system that will prevent entanglement during usage by interlacing the rubber bands through slots, easily detaching the rubber bands from the harness and other attachments such as foam handles or canvas Velcro™ sleeves for comfort and cleanliness of hands.

Resistance exercise devices comprising an elastic band or tube secured between two handles and worn by the user are a variety, which include belts and hand grips and foot straps but none of these devices have proved entirely suitable in terms of effectiveness of a sports specific total body work out. U.S. Pat. No. 5,813,955 discloses a universal personal exercising device having a belt worn around the torso plurality of attachment rings hand assemblies and resistant member this device will not offer any over loading of the muscle groups of the triceps, abdomen or oblique. U.S. Pat. No. 5,372,565 discloses a universal personal exercising device configuration that will allow user to experience heavy over loading of the muscle groups. Because of the awkward configuration movements of the hand would tighten the loop around the hand causing constriction of blood circulation and there fore resulting in further injuries over prolonged use.

SUMMARY OF THE INVENTION

It is therefore an object of the present invention to provide a personal total body endurance exercising device that improves strength and aerobically conditions the upper and lower body in comfortable manner without causing constriction of blood circulation.

It is a further object of the present invention to provide a light load high speed movement resistance method for simulating the cling and jerk, wrestling shadow boxing and provide for upper body eccentric movement such as torquing at the waist oblique maneuver resistance, shoulder rotations, triceps push downs and other exercises such as the squat press, triceps push down or standing press squats simultaneously and other compound exercise capabilities. It is a further object of the present invention to enable the user to physically move in the least amount of time that it takes to accomplish the task according to real world movement that's sports specific and also dynamically transition into a randomly selective variety of upper and lower body static exercise functions. Studies have shown that uses of hand weights are ineffective in enhancing weight loss or improving cardiovascular statistics also the use of inertia can cause stress and strain on ligaments and joints.

It is therefore provided in the present invention a light weight device that is anatomically correct and which is user friendly on the joints and tendons yet will enable the user to engage in high repetitions to failure and the ability to go beyond the intensity below which a mental or physical stimulus cannot be perceived and can produce no response.

The present invention allows for resistance increase and the user to work towards higher repetitions or what has become known as raising the anaerobic threshold which is the point at which the body can no longer meet its demand for oxygen. The anaerobic metabolism will be accelerated, ultimately user will be able to workout with the Intensity frequency and duration absolutely essential to increase strength, explosive power and the cardiovascular, VO2 max into the blood stream is indispensable in particularly the ability of the user to remove oxygen from the air and transfer it through the lungs and blood to the working muscles will be gained with the use of this device.

The present invention provides a human musculoskeletal exercising device of the type worn on the body which permits the rubber band to be detachably installed in order to increase or decrease the resistance.

According to the preferred embodiment of the present invention, the rubber band and connector arrangement comprise a cylindrical light weight tube preferably made of plastic vinyl and nylon straps, buckles, hook and loop fastening strips.

The present invention can also provide for the use of elastic tubes and cords and connector arrangement comprising a clamp made of an ultra high molecular weight plastic.

Briefly described according to the embodiment of the present invention, a water repellent shell harness could be manufactured by water jet is provided comprising particular rubber bands are attached and easily detached by interlacing the light, medium, or heavy rubber bands through the harness slots. The other end of the rubber band engages handles and foot straps in particularly the handles are comprised of a hallow cylinder preferably made of plastic PVC having a foam or sponge hand grips for comfort and cleanliness. Further the rubber band is pulled through PVC tubes slot grooves and is accessible at either distal end of the cylinder. Yet an object of the present invention is to provide a unique harness handle and toe and heel foot strap structure in an exercise device of the type described such that the rubber bands can be easily laced, connected in a configuration that will prevent entanglement and a break away release from the harness to the ground. In addition the rubber band is covered with a protection sleeve made of a closed cell sponge rubber material that traps the rubber band and slows down the velocity of the rubber band in the event of a break. The foot strap assembly may include canvas, foam; rubber and Velcro™ loop and hook section attached to nylon webbing. The rubber bands and a vinyl hose are connected to the foot straps toe, a heel strap with stirrups also comprise a vinyl hose in the nylon loop for securing the rubber band to a nylon strap extending around the bottom and back of the heel of the user, handle attachments are also at each end of the closed loop rubber bands after the rubber bands are interlaced through the upper body harness.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 3 is a perspective view of a simulated human musculoskeletal exercise device showing the harness exterior surface having rubber band adjustment and connecting component parts contained there on;

DESCRIPTION OF THE PREFERRED EMBODIMENTS

The best mode for carrying out the invention is presented in terms of its preferred embodiment, herein depicted within the Figures.

Figure 1:
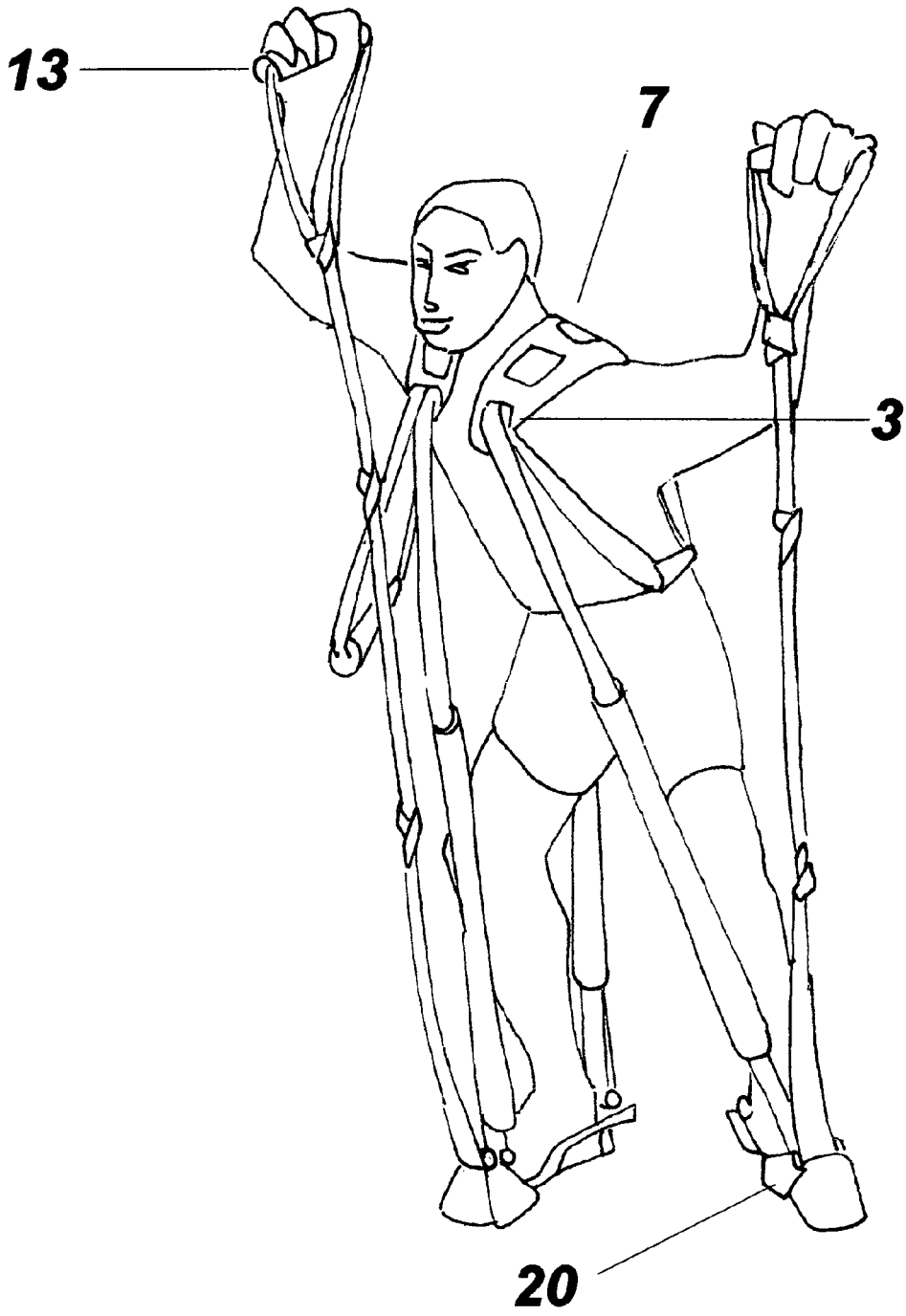
FIG. 1 is a perspective view of a simulated human musculoskeletal exercise device of the present invention showing a user demonstrating the cling and jerk exercise out doors while wearing the harness assembly with the foot strap and handles attached.

When referring to FIG. 1 the rubber bands 3 circumscribe the shoulders of the user each rubber band 3 attachment end hangs proportionally in length and laterally to the user's anterior and posterior body as to provide for balance and equal distribution of over loading the muscle groups when stretched. Foot straps 20 comprising handles 13 which can be made from a simple rectangular pattern made of canvas having Velcro™ edges in order to form a cylinder are attached around the rubber band 3 ends and provide the user hand comfort and the option of extending one or both arms or legs while simultaneously working the anterior and posterior muscles. The user's animations resemble a marionette while being within the boundary of the device; it is striking in appearance and is forcefully effective in performance.

Figure 2:
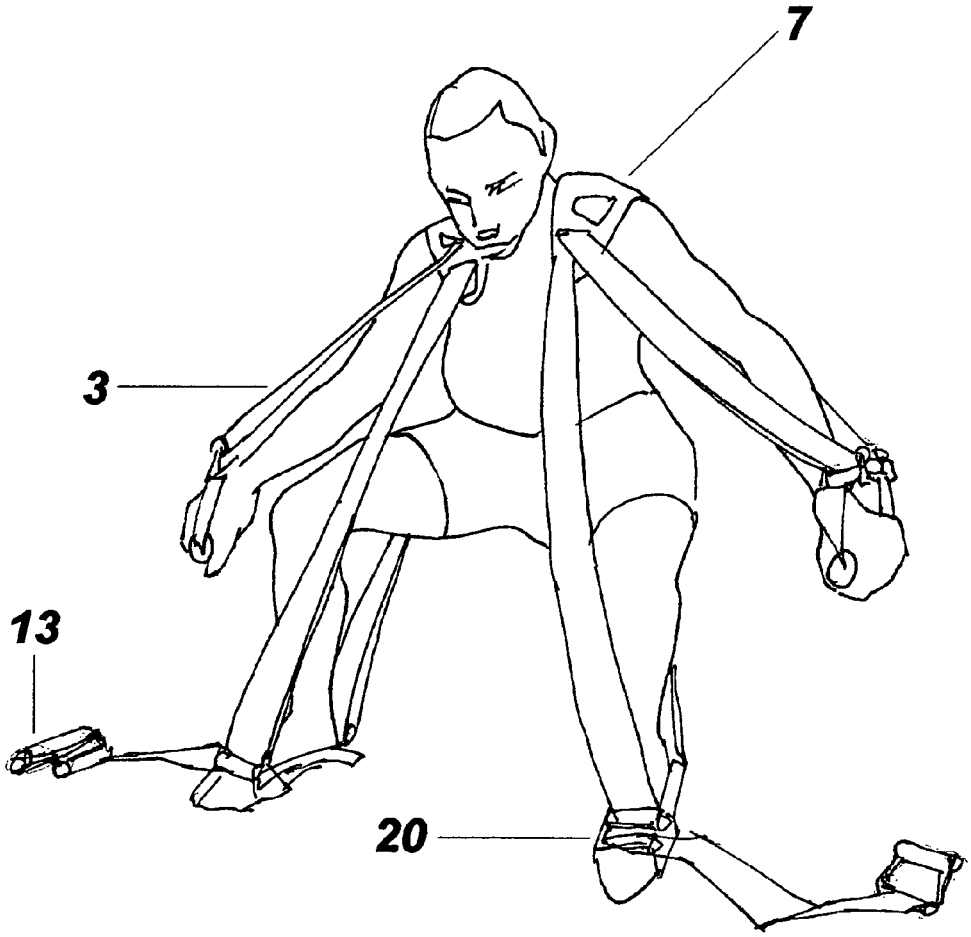
FIG. 2 is a front perspective view of a simulated human musculoskeletal exercise device showing user out doors or in a room while demonstrating a compound exercise such as triceps push downs simultaneously with squats while wearing the harness assembly with the foot straps and handles attached.

Referring to FIG. 2 the user squats to unload the lower body, the lower body rubber bands 3 span the height of the user when body and legs are fully extended in upright or lying down position the rubber bands can be selectively changed on the device assembly and connected in a configuration that will prevent entanglement.

Figure 3:
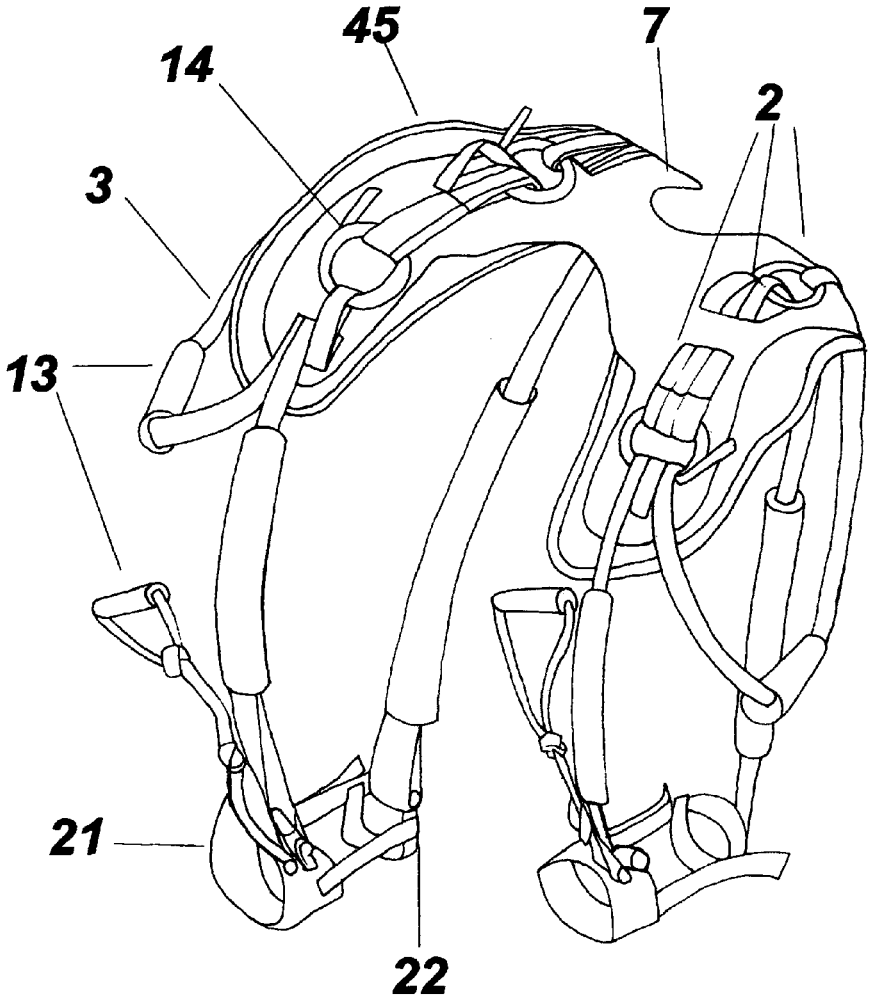
Figure 4:
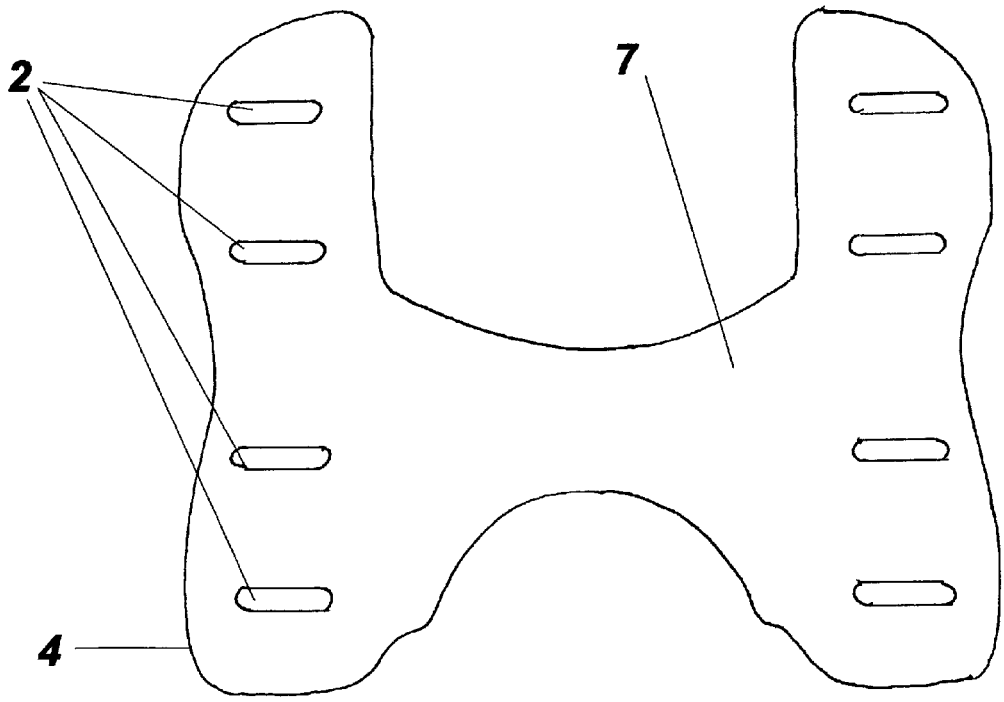
FIG. 4 is a top view a water repellent harness.
Figure 5:
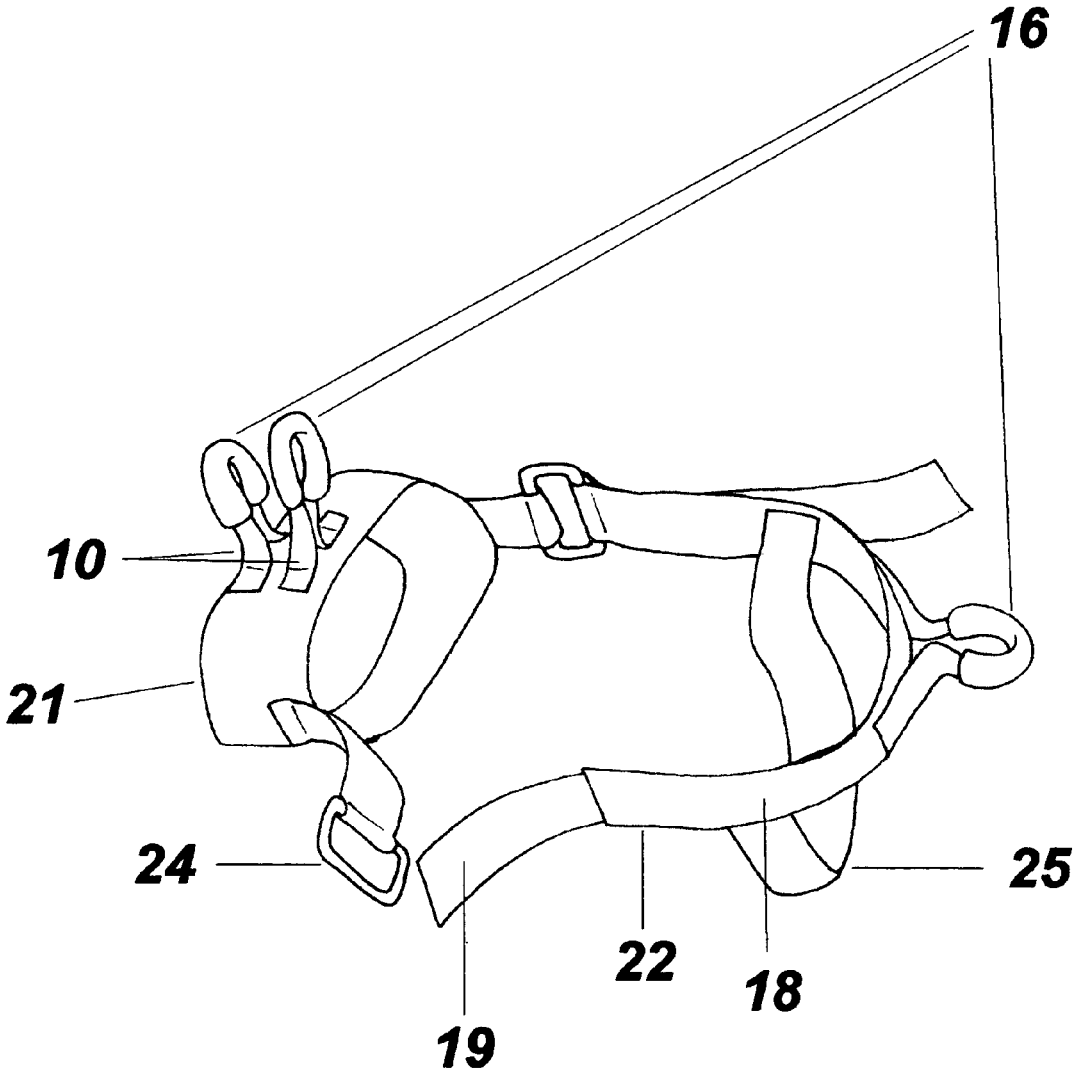
FIG. 5 is an orthographic view illustrating the foot strap heel and toe configuration showing the vinyl hose, nylon strap, buckle and loop and hook for removal attaching the foot strap to the foot.

Referring to FIGS. 3 and 4 the rubber bands are articulated from their interlaced slot 2 fixed points of the harness 7 which is worn above the user's shoulders covering the upper dorsal neck region. The harness 7 water resistant shell may be made of an ultra high molecular weight plastic. The harness pattern is cut out of the plastic sheeting and laminated to a closed cell sponge material 4 which serves as a load cushion; lamination is accomplished by using heat or adhesives. A secondary shoulder pad 45 is Velcro™ detachable to the harness. The user grips the handles 13 via canvas or foam 6 and extends the arms upward or downward and outward ballistically, while simultaneously squatting in cadence as to perform a triceps squat resistance exercise outdoors. This is one of many other beautiful upper and lower body exercise maneuvers called compounding. This device allows the user to physically move into the next function in the least amount of time minimizing time intervals between specific motor unit contractions and relaxation sequences, the physiological effects increase the cardiovascular performance of the user.

Figure 7:
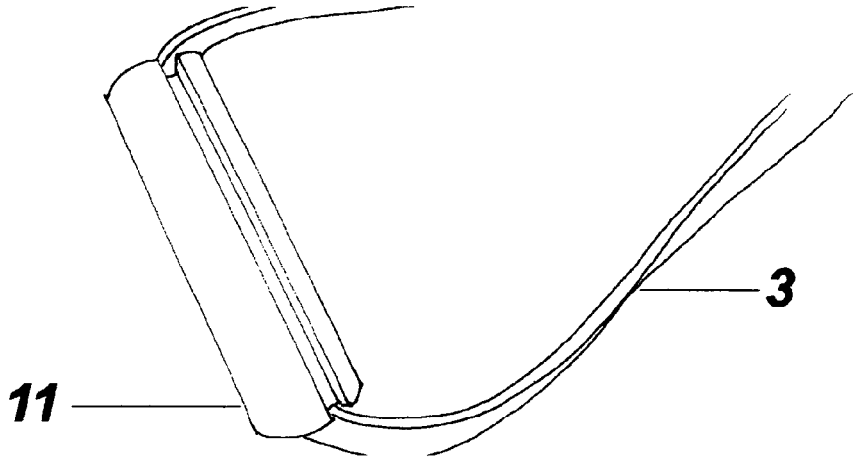
FIG. 7 is a front view of the foot handle assembly of the simulated human musculoskeletal exercise device showing the slot groove cylinder.
Figure 8:
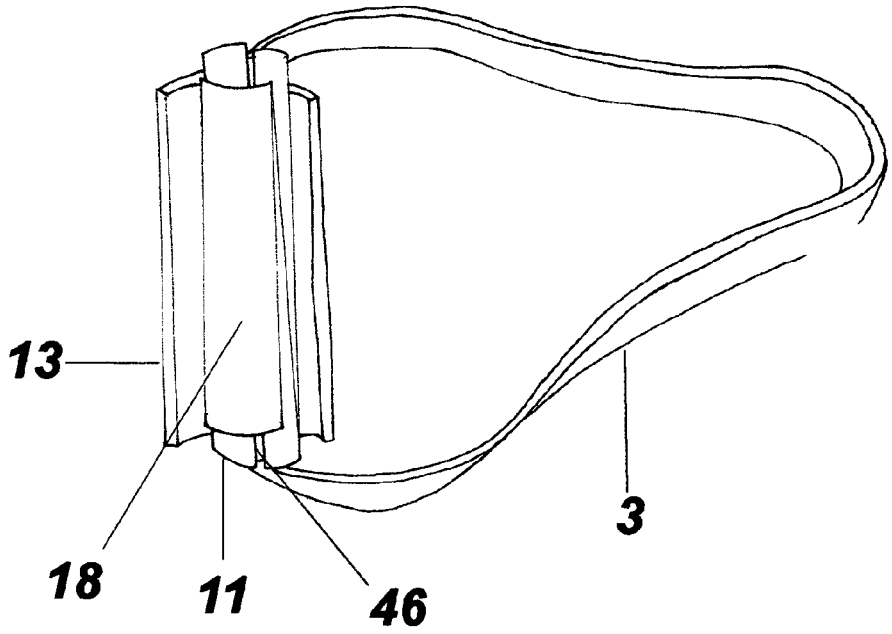
FIG. 8 is a front view of the harness handle assembly of the simulated human musculoskeletal exercise device showing the Velcro™ hook and loop foam grip assembly.

Referring to FIGS. 7 and 8 rubber bands 3 are accessible at either end of the cylinder 11 foam grip handles 13 and are pulled through the interior of the handle 13 cylinder 11 exposing the length of length of the rubber band 3 proportionally at each end of the handle 13 cylinder 11. The foot strap nylon straps are sewn together forming a loop 5 loosely around the rubber band. Two pieces of nylon strap 10 spaced apart and parallel to each other are sewn across the top of the toe strap 5 just at their mid point. A nylon strap is inserted through a piece of vinyl tubing and is sewn forming a ring 16. Further referring to FIG. 3, each end of the rubber band 3 is looped around one of the vinyl tube and tie wrapped 14. The rubber band resistance adjustment is performed by pulling the rubber band loop slack underneath the harness left side, then alternately pulling the rubber band loop slack underneath the harness even to the right side. Then pull the rubber band loop above the harness removing the slack underneath, therefore increasing the tension. The foot strap 20 assembly may include Velcro™ loop section 18 and hook section 19 attached by nylon webbing. Rubber bands 3 and handles 13 are connected to the foot straps toe 21 vinyl tube rings 16, a heel strap 22 comprising a stirrup 25, vinyl tube ring 16. Nylon heel strap 22 comprises Velcro™ loop section 18 and hook section 19. Heel strap 22 is one size fits all, adjustable to both sides of the foot strap assembly 20 and adjoin the foot strap heel 22 to foot strap toe 21 by using loop loc™ 24. Nylon heel straps 22 are inserted through the foot strap toe 21 loop loc 24 and are reversed back, Velcro™ loop section 18 and hook section 19 around the Achilles tendon heel of the user.

Figure 6:
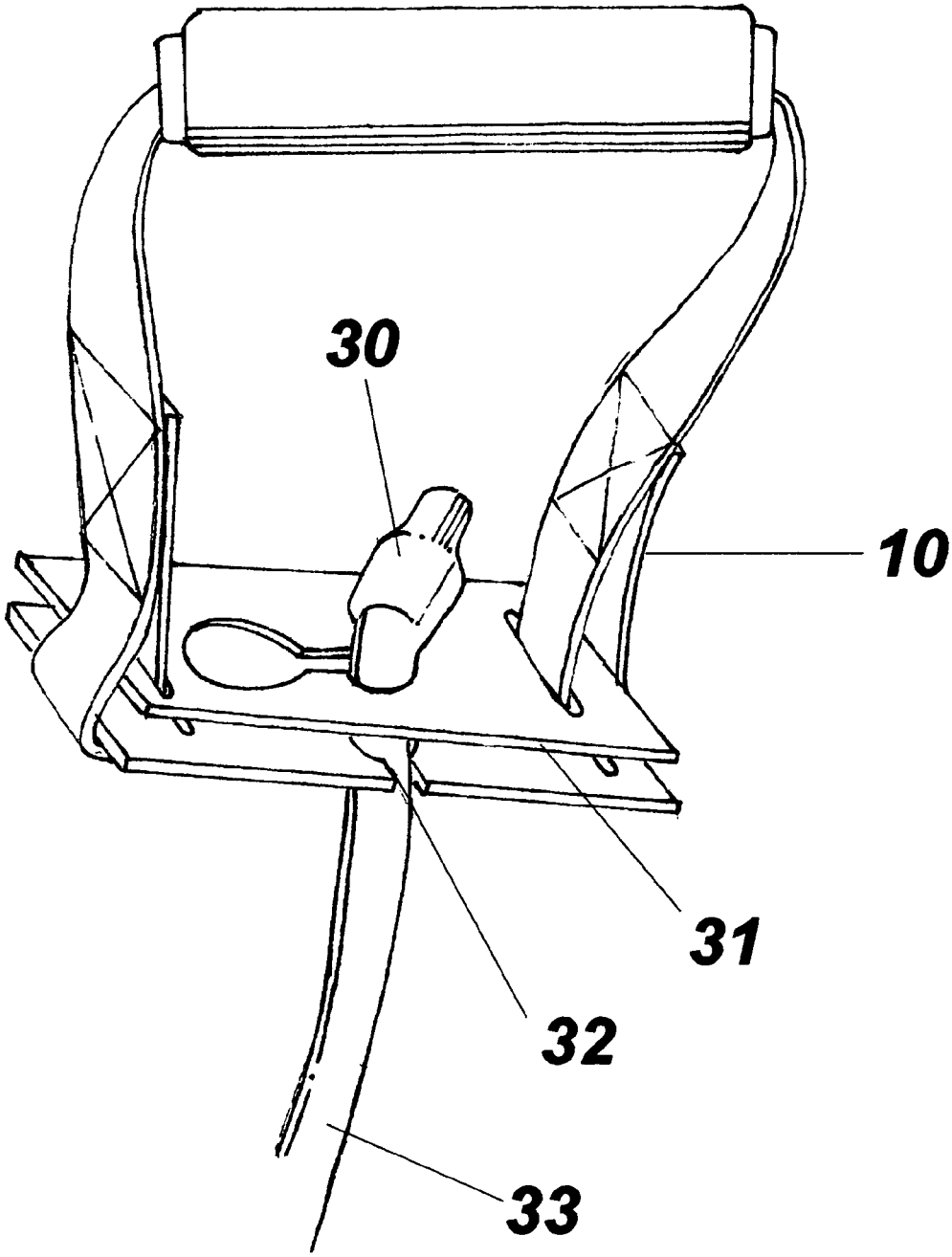
FIG. 6 is a perspective view illustrating the Ultra High Molecular Weight plastic clamp and elastic tube comprising a plug connection through the key way channel.
Figure 9:
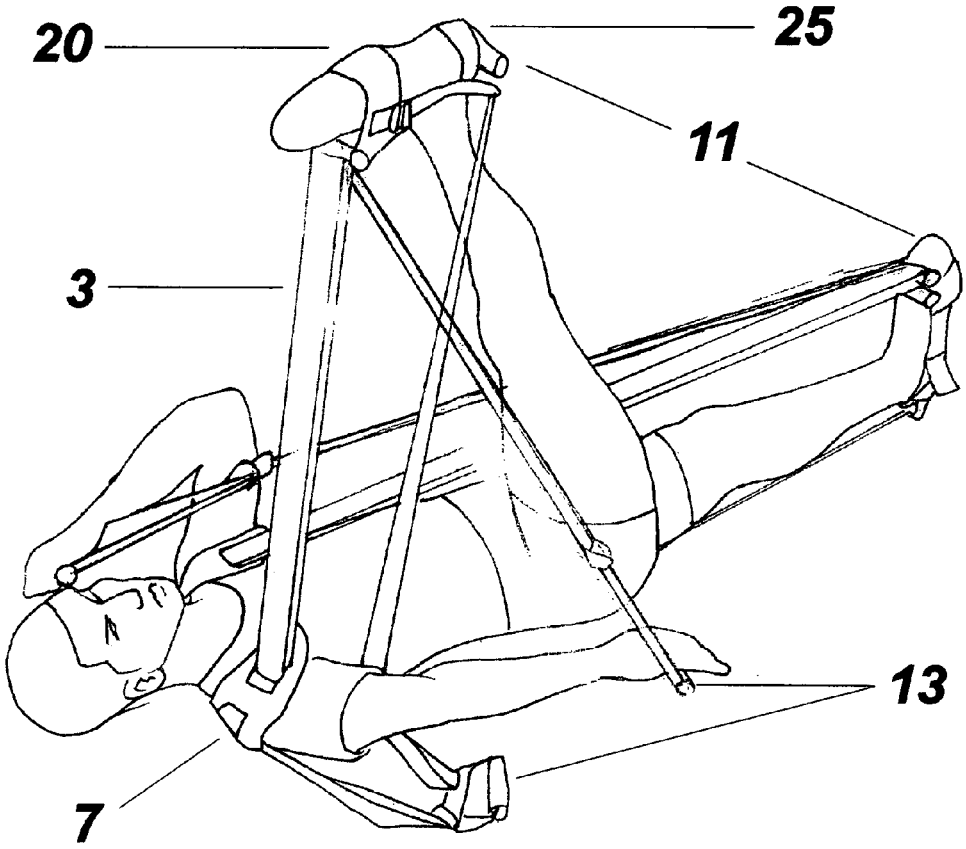
FIG. 9 is a perspective view of a simulated human musculoskeletal exercise device of the present invention showing a user demonstrating straight leg pull downs while wearing the harness assembly with the foot strap and handles attached

As shown in FIGS. 1, 2 and 3, the user is within the boundaries of the device by placing the harness 7, sponge material 4 comprising interlaced rubber bands behind the neck, rubber bands 3 for the upper and lower body circumscribe the shoulders as the user places their arms between the rubber band 3 anterior and posterior ends according to the body. Upper and lower body rubber bands 3 are also considered lateral to each arm of the user. Foot straps 20 are connected to a slightly longer rubber band 3 laced along side the relatively shorter upper body rubber bands 3 that are also interlaced through slot 2 of harness 7. Two lower body rubber bands 3 are weaved through the harness 7 over each shoulder then pulled through break away protection sleeves. The beginning weaving of each rubber band starts from the opposite or lateral slotted corners of the harness. Weave the two rubber bands midway through the harness and tie the two rubber band ends together using a tie wrap and vinyl tube at the midway position over the shoulder along the harness 7 exterior surface in order to secure the rubber bands necessary to stretch and engage with user's lower extremities placing a resistance load on the user. When worn the rubber bands 3 are placed lateral to the out side of the user's body as the user appears to be on the inside of the rubber band device. While sitting or kneeling down place the feet into the foot straps 20 the user adjust the nylon heel straps 22 to the size of the foot by inserting the heel straps 22 through loop loc 24 and are reversed back around the Achilles tendon heel Velcro™ loop section 18 and hook section 19. FIG. 6 shows alternatively an elastic tube or cord and connector arrangement comprising two clamps 31 of modular design resemble a small flat wafer is made of an ultra high molecular weight plastic, the set of clamps 31 fasten elastic tube or cord arrangement together. At each slotted end of the clamps 31 nylon straps 10 are inserted and pulled through the slots then the nylon straps are looped and sewn at each end of the clamps leaving enough space in the sewn loop in order to slightly separate the plastic clamps. Plugs 30 are injected into the elastic tubes 33 distal ends, crimped mechanical fasteners or tie knots may be attached to the cords distal ends. Either end may be inserted through the clamp key way holes while slightly separating the set of clamps each having a single notched channel 32 one clamp would have a lateral notched channel adjacent angle to the other channel which act as interconnecting passages. The elastic tubes 33 or cords are weaved between the clamps through the channels into a seat hole the elastic tubes 33 or cords are pulled in order to lock the clamps 31 and trap the elastic tubes 33 or cords. Referring to FIG. 2 user squats while grasping the handles 13 of the upper body rubber band 3 and performs a compound exercise when doing triceps push downs simultaneously to squats. Referring to FIG. 1 the user grasps the foot strap 20 handles 13. The rubber bands are tied in a knot, which serve as a link adjustments for varying the resistance by easily removing or adding a rubber band link. The user grasp the foot handles stands upright under the restraints of the device while curling or pressing more quickly and powerfully at high reps in order to stimulate more accurate transmission of instruction from the nervous system to the working muscles increasing squat resistance, and abduction-adduction exercises, straight leg pull downs, high speed ballistic stretching when wearing the harness assembly with the foot strap and handles attached shown in FIG. 9.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A human musculoskeletal exercising apparatus comprising:

a harness configured to conform over a wearer's shoulder forming a water resistant shell exterior, the harness comprising:

two side panels having slots formed therein, the side panels each having a ventral side and a dorsal side, the side panels configured in a curved manner to cover a wearer's front and back sides of the shoulder wherein the ventral side of the side panel covers part of the front side of the wearer and the dorsal side of the side panel covers part of the back side of the wearer, the slots arranged along the panels such that at least one slot is positioned on the ventral side of the side panel and at least one slot is positioned on the dorsal side of the side panel;

at least one rubber band connected to said harness, wherein said rubber band is attached or detached at a first end by interlacing a light, medium, or heavy rubber band through slots formed by the harness, wherein the band is threaded through at least one slot in the ventral side of the side panel and the dorsal side of the same side panel, such that band is configured to loop over the top of the wearer's shoulder when the apparatus is worn, forming one part of the band emerging from the front of the wearer's shoulder and one part of the band emerging from the back of the wearer's shoulder; and the rubber band connected to through handles or to foot straps, wherein the band's connection to the foot strap or through handle completes a loop around the shoulder to the foot strap or handle and back the shoulder, wherein when the foot strap or through handle is pulled by the user, the apparatus forms two lines of tension from the shoulder to either the through handles or foot straps via two parts of the band, one emerging from the front of the wearer and one emerging from the back of the wearer;

wherein said human musculoskeletal exercising apparatus is adapted to be worn on the body in a manner such that the user can get a feel for constant dynamic motion while ballistically stimulating and strengthening the muscles of the upper and lower body.

2. The exercising apparatus of claim 1, wherein said rubber band is secured to said harness by a load tie wrap and further wrapped around a vinyl tube such as to prevent damage to said rubber band during tensioning.

3. The exercise apparatus of claim 2, wherein said rubber band is connected to said foot straps by a vinyl tube nylon loop formed by threading or sewing.

4. The exercise apparatus of claim 2, wherein said handles have a single slot or track in which to receive the rubber band and allow it to be seated in cylinder in stirrup type fashion, and wherein said rubber band is connected to said handles by stretched through slots formed in said handles.

5. The exercise apparatus of claim 1, wherein said water repellent shell harness is manufactured by water jet.

6. The exercise apparatus of claim 4, wherein said handles are comprised of a hollow cylinder having a foam or sponge hand grips on an exterior surface for comfort and cleanliness.

7. The exercise apparatus of claim 4, wherein said rubber band can be pulled through said hollow cylinders in a manner that is accessible at either distal end of the cylinder.

8. The exercise apparatus of claim 1, wherein said rubber band further comprises a protection sleeve made of a closed cell sponge rubber material that traps the rubber band and slows down the velocity of the rubber band in the event of a break.

9. The exercise apparatus of claim 1, wherein a plurality of said rubber bands are provided, each said rubber band formed of a continuous loop, rubber material formed in seamless layers such as to form a continuous loop with first and last layers finished on different planes at least 3 inches apart to form a 1 piece band with no week weak spot.

10. The exercise apparatus of claim 1, wherein said harness further comprises secondary, removable shoulder pads.

11. The exercise apparatus of claim 3, wherein said foot straps comprise a secondary barrier layer forming a wear-resistant, impact and abrasion and cushioning sole pad element.

12. The exercise apparatus of claim 1, wherein said barrier layer is formed by dipping in multi-purpose rubber or plastic coating.

13. The exercise apparatus of claim 1, wherein the band comprises a first band, the first band connected to a handle, and the apparatus further comprising a second band threaded through slots on the same side panel as the first band, and emerging from slots adjacent the first band, wherein the second band is connected to a foot strap, wherein the connection completes a loop around the shoulder to the foot strap and back to the shoulder, and wherein the band's connection to the foot strap completes a loop around the shoulder to the handle and back to the shoulder, wherein when the foot strap is pulled by the user, the apparatus forms two lines of tension from the shoulder to either the through handles or foot straps or both, via two parts of the band, one emerging from the front of the wearer and one emerging from the back of the wearer.

14. The exercise apparatus of claim 13, wherein the second band emerges from slots below the first band on the dorsal and ventral sides of the side panel.

15. The exercise apparatus of claim 13, wherein first and second bands are threaded through slots on both side panels forming four loops.

* * * * *